United States Patent [19]

Mount

[11] Patent Number: 5,053,621

[45] Date of Patent: Oct. 1, 1991

[54] ELECTRO-OPTICAL ION DETECTOR FOR A SCANNING MASS SPECTROMETER AND METHOD OF MAKING SAME

[75] Inventor: Bruce E. Mount, Diamond Bar, Calif.

[73] Assignee: Bodenseewerk Perkin Elmer GmbH, Uberlingen, Fed. Rep. of Germany

[21] Appl. No.: 616,123

[22] Filed: Nov. 19, 1990

Related U.S. Application Data

[63] Continuation-in-part of Ser. No. 544,798, Jun. 25, 1990, Pat. No. 4,994,676, which is a continuation of Ser. No. 312,514, Feb. 21, 1989, abandoned.

[51] Int. Cl.[5] ..... H01J 39/44

[52] U.S. Cl. ..... 250/298; 250/299; 250/300; 250/397

[58] Field of Search ..... 250/298, 299, 300, 397, 250/213 VT, 281, 282; 350/46.21, 46.23, 46.24, 46.25, , 96.27, 96.25, 96.24

[56] References Cited

U.S. PATENT DOCUMENTS

| | | | |
|---|---|---|---|
| 3,955,084 | 5/1976 | Griffin | 250/299 |
| 4,514,628 | 4/1985 | Frehaut et al. | 250/298 |
| 4,994,676 | 2/1991 | Mount | 250/298 |

*Primary Examiner*—Jack I. Berman
*Assistant Examiner*—Kiet T. Nguyen
*Attorney, Agent, or Firm*—Thomas P. Murphy; Edwin T. Grimes

[57] ABSTRACT

An improved electro-optical ion detector comprising a channel electron multiplier assembly located at the angled focal plane of the magnetic sector of a scanning mass spectrometer with a twisted fiberoptic window with a means for precisely optically coupling the assembly to the twisted fiberoptic window. Means are provided for precisely spacing the entrance end of said twisted fiberoptic window in the form of a foil of a selected thickness. Also disclosed is a method for making an improved electro-optical ion detector.

6 Claims, 5 Drawing Sheets

ELECTRO-OPTICAL ION DETECTOR FOR A SCANNING MASS SPECTROMETER AND METHOD OF MAKING SAME

This is a continuation-in-part of application Ser. No. 07/544,798, filed Jun. 25, 1990 now U.S. Pat. No. 4,994,676 which is a continuation of application Ser. No. 07/312,514 filed Feb. 21, 1989 now abandoned.

BACKGROUND OF THE INVENTION

This invention relates, in general, to scanning mass spectrometers which have an electro-optical ion detector located at an angle to the exit plane of the magnetic sector of the mass spectrometer and which comprises a channel electron multiplier assembly to which a twisted fiberoptic window is optically coupled for transferring light energy generated by the ions to a photo diode detector to enable detection of ions over a wide mass range. Such as electro-optical ion detector in a scanning mass spectrometer is disclosed in the parent application and this invention is particularly directed to an improvement in the optical coupling between the channel electron multiplier assembly and the twisted fiberoptic window. This invention also includes the method of making such an improved electro-optical ion detector.

The parent application also disclosed a method of making the twisted fiberoptic window in such a manner that the entrance end of the twisted fiberoptic window could be placed parallel to the image intensifier plate and parallel to the photodiode array which, in turn, was parallel to the exit plane of the magnetic sector of the mass spectrometer. The reason for the configuration of the twisted fiberoptic window is fully explained in the parent application.

The electro-optical ion detector of the parent application performs very well but it was found that the spacing between the channel electron multiplier assembly and the entrance of the twisted fiberoptic window, while known to be important, was difficult to achieve with any consistency. If the spacing was not precise, Moire patterns were formed which obscured the data being measured. To improve this spacing between the channel electron multiplier assembly and the entrance to the twisted fiberoptic window so that the spacing is consistent and easily obtained is the main thrust of this invention. This invention also teaches a method of making such a space easily obtainable.

While the following background information was fully disclosed in the parent application, for convenient reference, most of the disclosure in the parent application is reproduced hereinafter and where possible the same reference numerals are used in this application as used in the parent application for the same reason. However, reference should be made to the parent application for any necessary clarification.

Attention is directed to FIGS. 1-4 which are disclosed in the parent application.

FIG. 1 shows an artist rendition of a prior art double focus scanning mass spectrometer 10 comprising a sample inlet 12 having an ion source 14 with an ionizing region 16 in which sample gas molecules are subjected to an electron beam 20 to form an ion beam 22. The ion beam 22 is directed through an electrostatic section 24 and a magnetic sector 26. Ions traveling through the magnetic sector are scanned as at 30 and those of a selected mass are focused at focal point 32 and directed through a narrow slit 34 to an electron multiplier 36.

In this instrument, ions of slightly higher and lower mass focus along a nearly straight line focus, i.e., focal plane 44, which passes through the axial focal point 32 and which lies at an angle to the axis 34. This focal plane 44, called an angled focal plane, is illustrated in phantom in FIGS. 1*a* and 1*b*.

As can be seen in FIG. 1*b*, because of the geometry of the instrument, the ions which have slightly higher and lower mass, identified therein as 32*a*, 32*b*, 32 *c* and 32*d*, by way of example, are ordinarily not detectable since they are blocked from entering the electron multiplier 36 and will continue to be blocked and undetected until the magnitude of the magnetic field is increased or decreased (also called stepped or adjusted) to bring these ions into focus and directed to the electron multiplier 36.

The invention of the parent application provided a means for detecting ions along this angled focal plane using an electro-optical ion detector with the image intensifier plate 80 of a channel electron multiplier assembly placed at the angled focal plane giving essentially simultaneous analysis of a limited range of ion masses, but switchable over several ranges for detection over a wide mass range.

As shown in FIG. 2, the microchannel or image plate 80 is a circular glass structure with a plurality of channels 82 in which straight channel electron multipliers 84 are placed and optically coupled to a fiberoptic window 86 the ends of which are coated with a phosphor to form a screen 90 as shown in FIG. 3. The components shown in FIG. 3 are suitably clamped together by bolts 92, to form a channel electron multiplier assembly 94 which operates the same as the channel electron multiplier assembly of FIG. 2. Assembly 94 is commercially available and are commonly supplied with the fiberoptic window 86 covered with the phosphor coating 90 which converts the secondary electron energy into a visible light image, which is guided through the fiberoptic window 86.

As disclosed in FIG. 4, which corresponds to FIG. 4 of the parent application, an electro-optical ion detector 100 is connected at the exit plane 102 of the magnetic sector 26 of the scanning mass spectrometer 10. The exit plane is shown schematically and also shown coupled to the top of a vacuum envelope 104 with an exit plane 106 located at the magnetic center of curvature 110 so that ions will be directed toward the surface of the image plate 80 of the channel electron multiplier assembly 94 within the vacuum element 104. The image plate 80 of the channel electron multiplier assembly 94 corresponds to the device shown in FIG. 3 and the same reference numerals are used in this figure for simplicity purposes. High and low mass ions 32*a* and 32*c*, outwardly of the central ion beam 32*b*, are focused and shown impinging on the surface of the image plate 80 as described in FIGS. 1*a*-*b*.

The image plate 80 is located at an angle to the exit plane 106 which corresponds to the angled focal plane 44 and is supported by a support plate 112 which, in turn, is supported by a pedestal 114 positioned on the lower body member as shown in FIG. 9. The envelope 104 is formed by two body members 116 and 120 and a flexible coupling 22 and the vacuum in the vacuum envelope is maintained by a vacuum pump 124. The two body members 116 and 120 are movable relative to one another by a plurality of adjustment screws 126 to vary the location of the image plate 80 relative to the exit plane 106. Transducers (linear variable differential transformers) 130 provide a means of precise measurement of the position of the lower body member 120 relative to the upper body member 116 from which the position of the image plate 80 may be determined.

The support plate 112 has a central rectangular shaped aperture 132 through which a twisted fiberoptic window 134 is optically coupled to the fiberoptic window 86 containing the phosphor coating 90 and extends through an opening in the vacuum flange 120. The photodiode array 140 is connected to suitable electronics 142 to provide the necessary signal generated by the detector ions. The photodiode detector 140 is disposed parallel to the exit plane 106.

As shown in this FIG. 4, the twisted fiberoptic window 114 is shaped in such a way as to enable the entrance ends of the fibers to be parallel to the angled image plate 80 and the exit ends 134 of the fibers to be positioned parallel to the exit plane 102 of the magnetic sector 26. The reason for this configuration of the twisted fiberoptic window 134 is fully explained in the parent application. Also disclosed in the parent application is the fact that the ends of the fibers of the twisted fiberoptic window 134 are ground and polished for maximum light acceptance efficiency.

Again, the optical coupling between the channel electron multiplier assembly 94 and the twisted fiberoptic window 134 is important but heretofor there was no way in which the spacing between the assembly 94 and the window 134 could be obtained with consistency for the maximum transfer of light energy from the assembly 94 to the window 134 and it is an object of this invention to provide an electro-optical ion detector with precise spacing for the maximum transfer of energy from the channel electron multiplier assembly 94 to the twisted fiberoptic window 134. Another object of this invention is a method of making an improved electro-optical ion detector for use in a mass spectrometer.

SUMMARY OF THE INVENTION

This invention comprises an improved electro-optical ion detector comprising a channel electron multiplier assembly located at the angled focal plane at the exit of the magnetic sector of a scanning mass spectrometer with a twisted fiberoptic window with a means for precisely spacing the entrance end of the fiberoptic window from the channel electron multiplier assembly for more efficient optical coupling therebetween. This invention includes a foil of a precise thickness positioned on the entrance end of the fiberoptic window to provide such a precise spacing. This invention also includes a method of providing a precise spacing between the channel electron multiplier assembly and the twisted fiberoptic window.

DETAILED DESCRIPTION

Having described the problem solved by this invention in the Background, above, this invention will now be described in detail in connection with FIGS. 5–9.

Figure 1B:
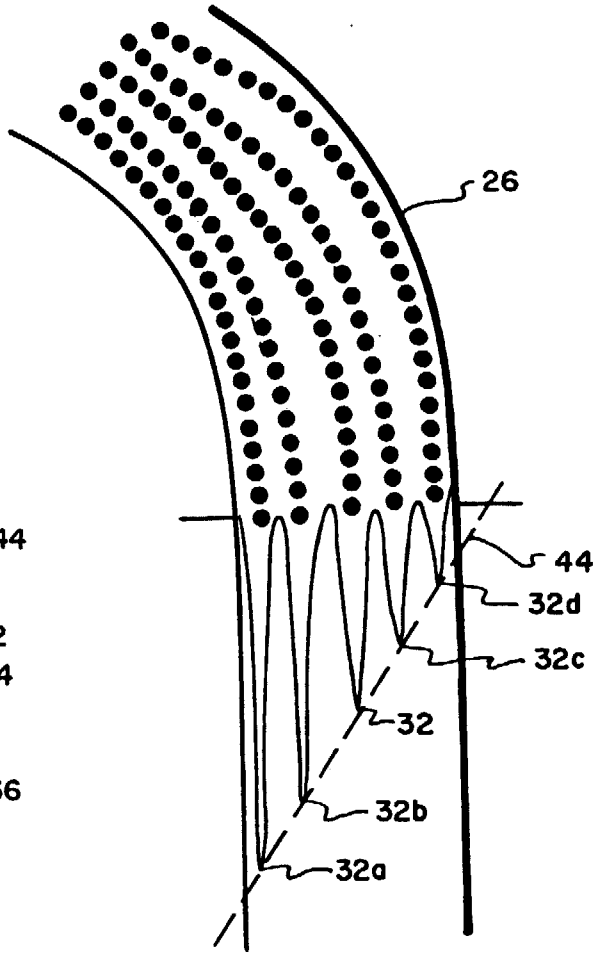
Fig. 1b. PRIOR ART
FIG. 1*b* is an enlargement of the area near the angled focal plane of FIG. 1*a*, FIGS. 2 and 3 illustrate the components of a channel electron multiplier assembly.
Figure 1A:
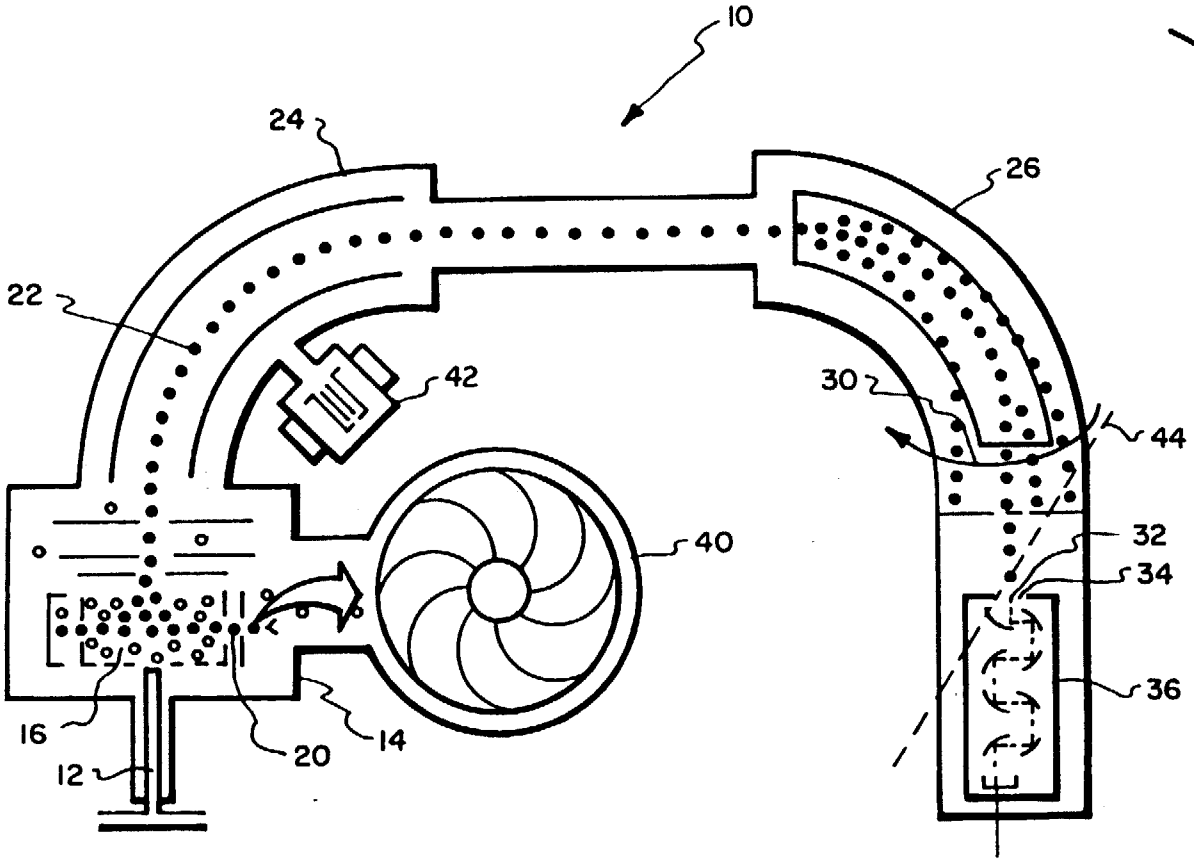
Fig. 1a. PRIOR ART
FIG. 1*a* is a schematic illustration of a prior art scanning mass spectrometer with an electron multiplier in the detector section as described above.
Figure 2:
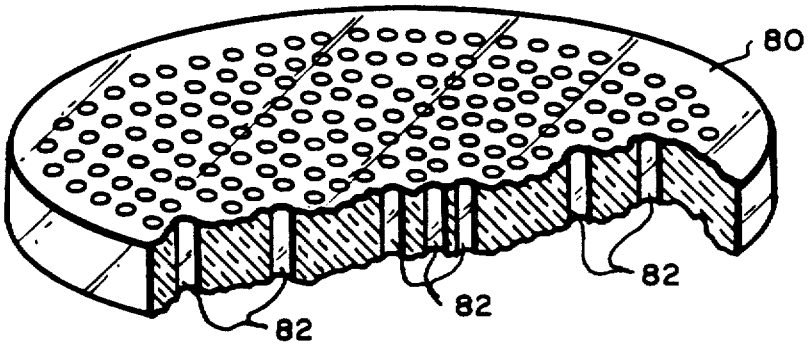
Fig. 2. PRIOR ART
Figure 3:
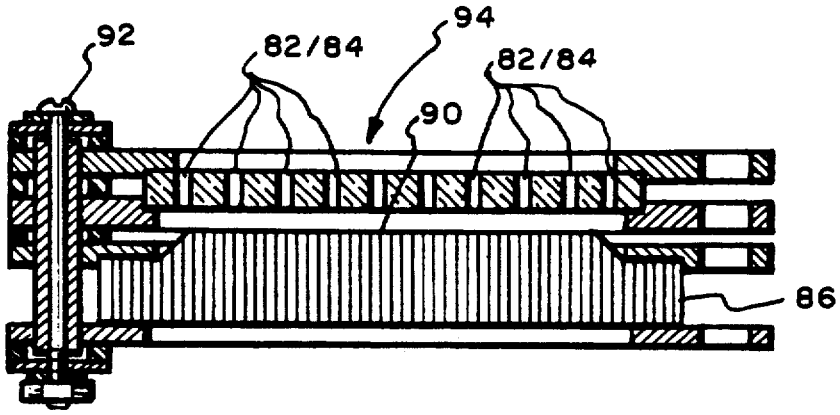
Fig. 3. PRIOR ART
Figure 4:
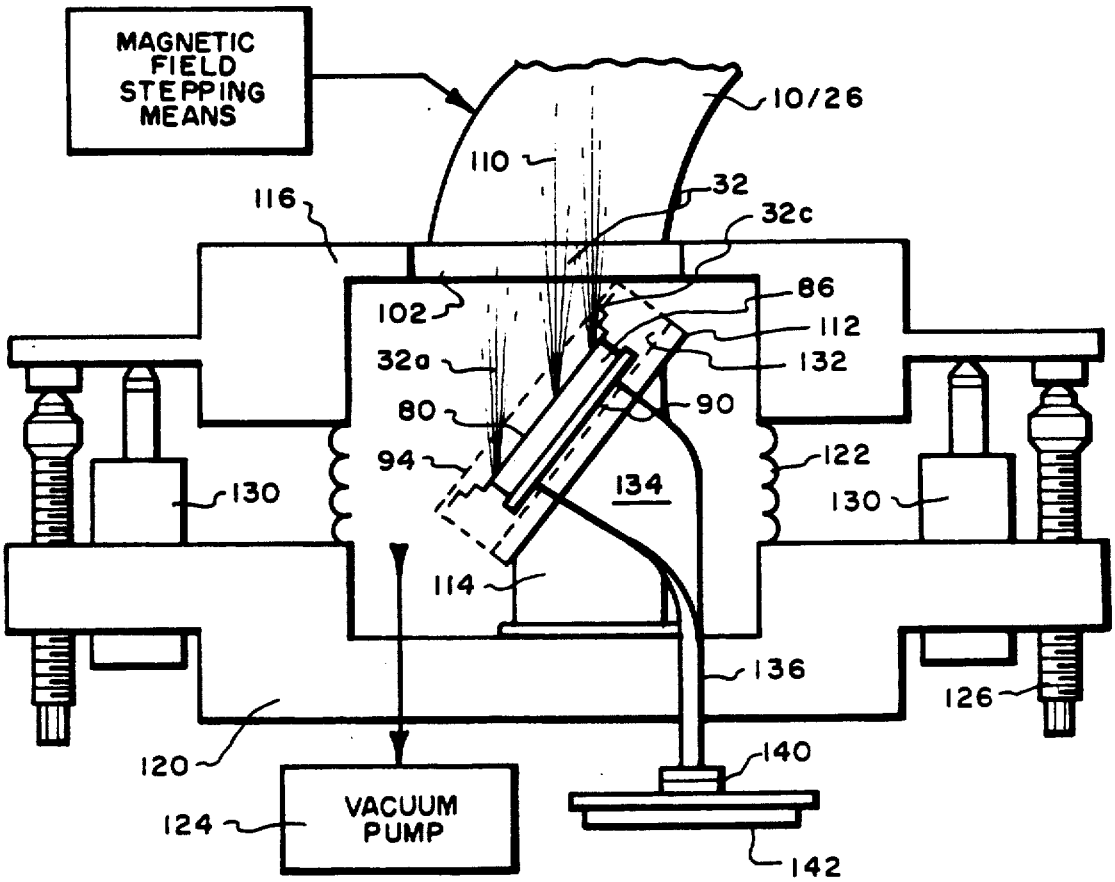
FIG. 4 illustrates the electro-optical ion detector including a twisted fiberoptic window coupled to a specially positioned channel electron multiplier assembly and to a photodiode array.
Figure 5:
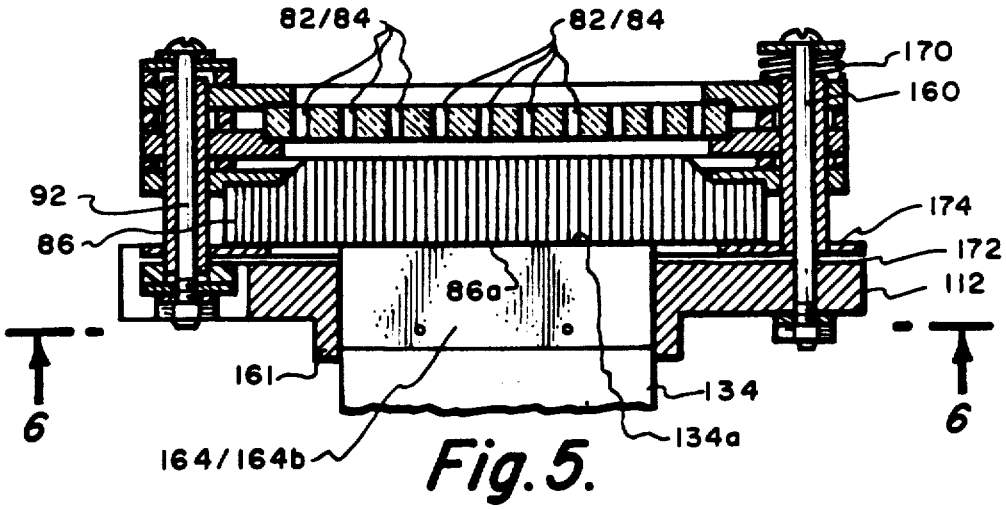
FIG. 5 shows the channel electron multiplier assembly with the twisted fiberoptic window precisely positioned.
Figure 6:
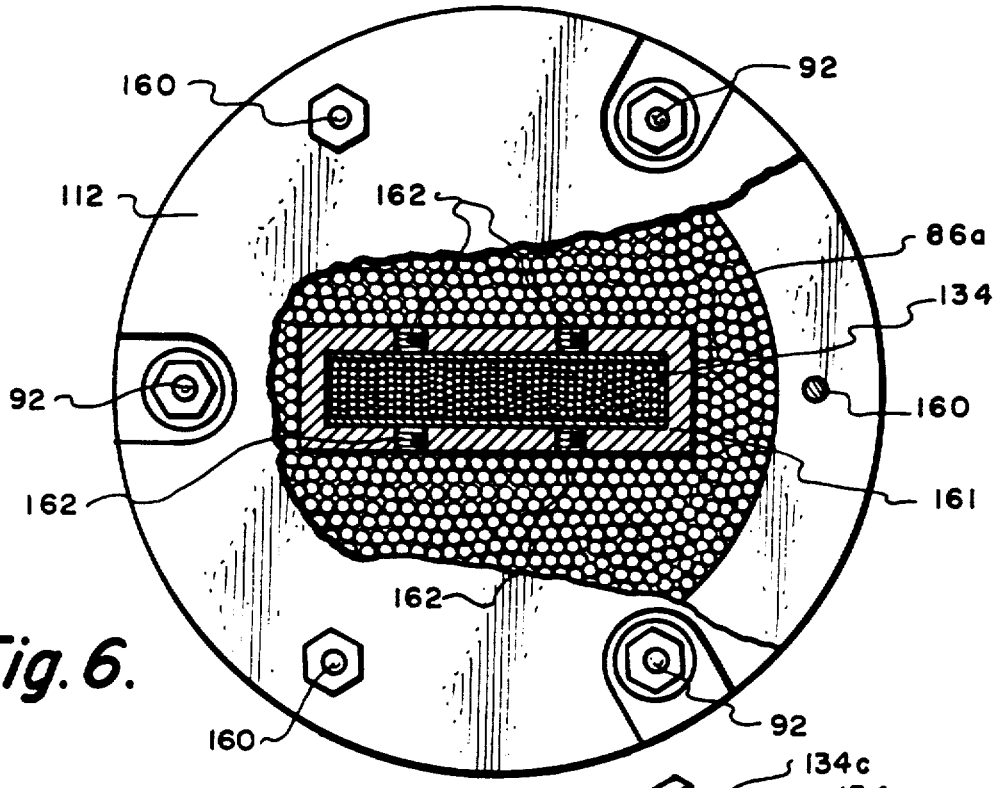
FIG. 6 is a bottom view of the support plate of FIG. 5, taken along lines 6—6 of FIG. 5.
Figure 7:
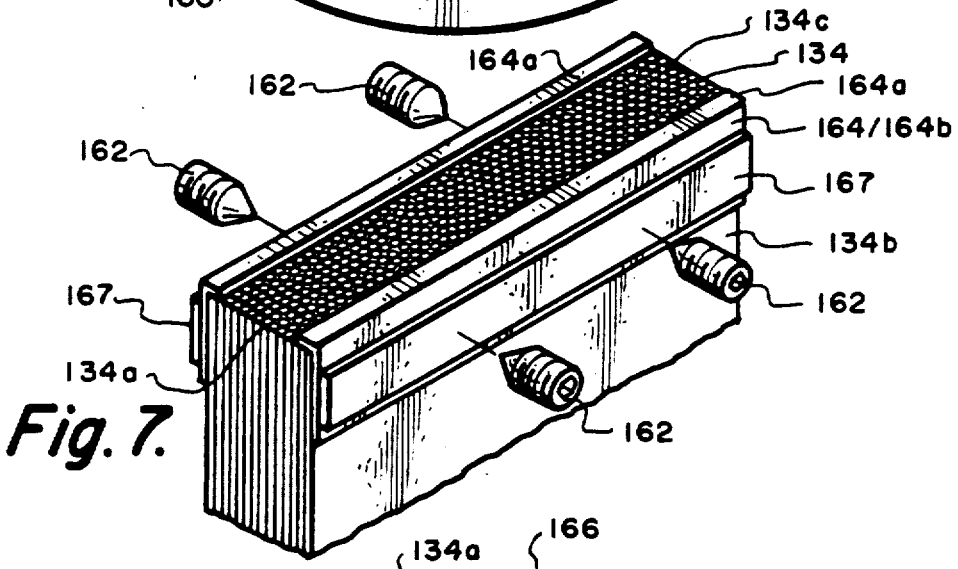
FIG. 7 is a perspective view of the twisted fiberoptic window with the spacing means for positioning the twisted fiberoptic window.
Figure 8:
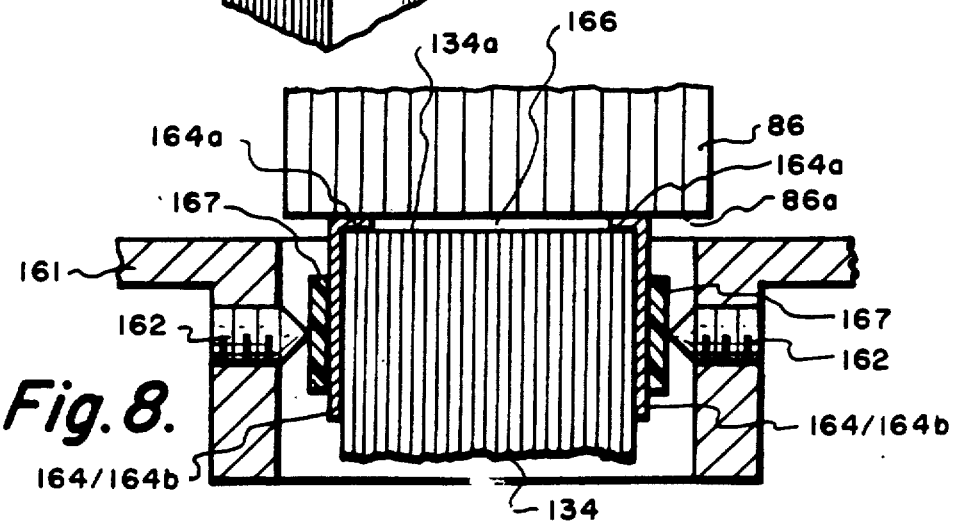
FIG. 8 is a schematic illustration of the two fiberoptic windows of FIG. 5 and 7 and the spacing therebetween.
Figure 9:
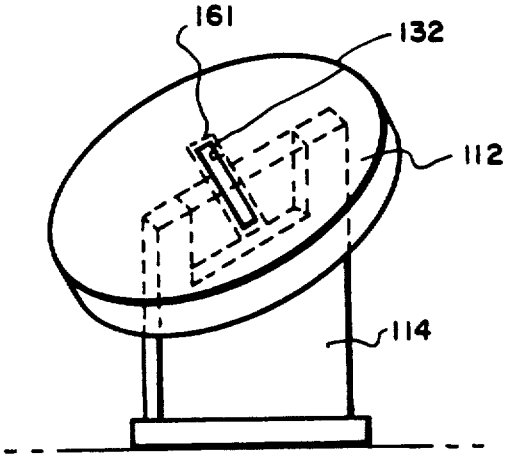
FIG. 9 illustrates the support plate for the channel electron multiplier assembly and pedestal for supporting the entire assembly.

FIG. 5 illustrates the channel electron multiplier assembly 94 with its fiberoptic window 86 and the twisted fiberoptic window 134 within the rectangular aperture 132 in the support plate 112. In addition to three bolts 92 which clamp the components of the channel electron multiplier assembly 94 together, one of which is shown in FIG. 4, and shown in FIG. 6 located 120 degrees apart, there are also three bolts 160 to clamp the support plate 112 to the channel electron multiplier assembly 94. These bolts 160 are also shown spaced 120 degrees apart in FIG. 6. This support plate 112, shown on a pedestal 114 in FIG. 9, is provided with a downwardly extending flange 161 surrounding the rectangular aperture 132 through which a plurality of set screws 162 extend as shown in FIG. 6 to hold the twisted fiberoptic window 134 in place.

In FIG. 5 the entrance end 134*a* of the twisted fiberoptic window 134 itself appears to engage the bottom or exit end 86*a* of the fiberoptic window 86, but, in fact, the entrance and 134*a* is spaced from the exit end 86*a* by the thickness of foil 164. This foil forms a spacing means and is shown as two strips in the perspective view, FIG. 7. These strips of foil 164 are formed so that two thin strips 164*a* overlap the entrance end 134*a* and wider strips 164*b* engage the sides 134*b* of the fiberoptic window 134. The two thin strips 164*a* leave the central part 134*c* exposed for the entrance of light into the fiberoptic window 134. These top strips 164*a* engage the exit end 86*a* of the fiberoptic window 86 and space the entrance end 134*a* from the exit end 86*a* and this spacing 166 is clearly shown in FIG. 8. Note, this view also shows the difference in diameter between the optical fibers of the windows 86 and 134.

These foil strips 164 are preferably of platinum 0.0003 inch thick to provide the spacing 166 of the same width. Platinum is preferred because it is malleable, is softer than glass, is available in 0.0003 inch in thickness and is strong enough to withstand the pressure between the two fiberoptic windows.

This space 166 provides the optical coupling between the fiberoptic window 86 and the twisted fiberoptic window 134 and in such a manner that the exit end 86*a* and the entrance end 134*a* are parallel and the formation of Moire patterns between two fibers of the two fiberoptic windows of different thicknesses are avoided. Moire patterns are systemic intensity variations due to the end of an optical fiber bundle of one pitch being placed directly adjacent to the end of another fiberoptic window of a different pitch (pitch equals center-to-center spacing of the fibers). A space of a few wavelengths of light eliminates this problem.

Figure 10A:
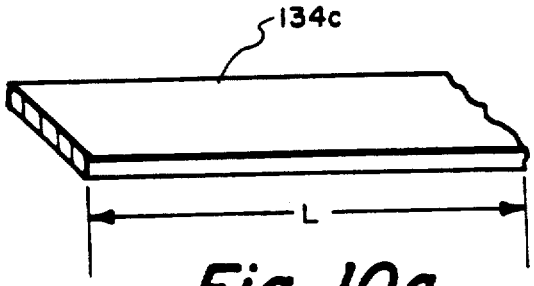
FIG. 10*a*–10*e* illustrate the manner of forming the twisted fiberoptic window.
Figure 10B:
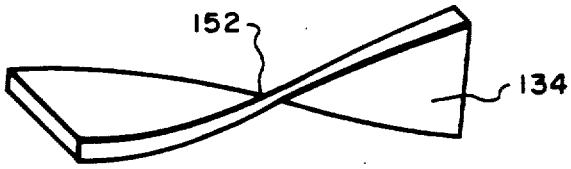
Figure 10C:
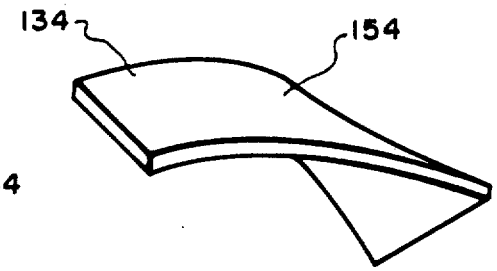
Figure 10D:
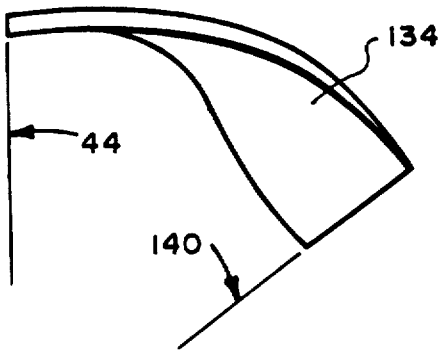
Figure 10E:
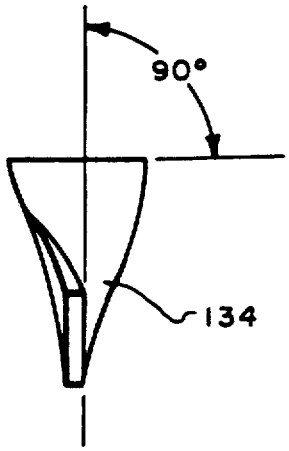

FIGS. 10a–10e show the manner in which the fiberoptic window 134 is formed. These figures are shown in the parent application as FIG. 6c–6g but reproduced herein for convenient reference and because the formation of the twisted fiberoptic window 134 forms part of the electro-optical ion detector and the method of making same. As explained in the parent application, the fibers are drawn and fused into bundles which are rectangular in cross section and several coherent bundles are drawn through a die (not shown herein) under control heat to form a fused glass ribbon which is cut into a predetermined length L as shown in FIG. 10a. The width of the ribbon is equal to the length of the desired focal plane and the thickness is kept as thin as the width of the exit image will allow depending upon the width of the image plate 80 and the photodiode detector array 140. After the fibers are fused into the ribbon shape, the ribbon is allowed to cool. After cutting to length, the ribbon is reheated and first twisted 90 degrees as shown at 152 in FIG. 10b and then bent beyond the twisted portion 152 as shown at 154 in FIGS. 10c and *e*. By forming this latter angle beyond the twisted portion 152, minimum compression and stretching of the fibers takes place assuring minimum distortion of the exit image. The ends of the fibers are then ground and polished perpendicular to the axes of the fibers for maximum light acceptance efficiency.

Thereafter, one end of the fibers, selected to be the entrance end 134a, is then coated with a very thin layer of an adhesive, such as Torr Seal, to cement the two strips of foil 164 to the sidewalls 134b of the twisted fiberoptic window 134. Torr Seal is selected since it is tolerant to vacuum. Thereafter, the foil 164 is bent over the entrance end 134a to form two foil strips 164a leaving the central portion 134c exposed. Viton strips 167 are then cemented to the foil sidewalls 164b with Torr Seal. The completed twisted fiberoptic window 134 is then positioned in the rectangular aperture 132 of the support plate 112 and the set screws 162 are brought into engagement with the Viton strips 167 to hold the twisted fiberoptic window 134 in place.

The channel electron multiplier assembly is then mounted over the foil covered end of the twisted fiberoptic window 134 with the channel electron multiplier plate fiberoptic window 86 in direct contact with the foil layers 164a and tension is then applied by three springs 170, as shown in FIG. 5, located under the heads of the three mounting screws 160. A slight space 172 is provided between the multiplier assembly fiberoptic window 86 and spacer 174 on the support plate 112 to accomodate the resilient force applied by the springs 170 so that a uniform spacing 166 (FIG. 8) between the fiberoptic window 86 and the twisted fiberoptic window 134 is maintained.

I claim:

1. In a scanning mass spectrometer with a magnetic sector with an exit plane and an electro-optical ion detector which includes a channel electron multiplier assembly with an image plate and a first fiberoptic window with an exit end and wherein the image plate is placed at an angle to the exit plane and a second fiberoptic window having an entrance end coplanar with said image plate and an exit end coplanar with a photodiode detector and wherein said second fiberoptic window comprises a plurality of optic fibers arranged in a flat ribbon-like configuration and twisted and having an entrance end, the improvement wherein spacing means are provided to form a precise space between said entrance end of said second fiberoptic window and said exit end of said first fiberoptic window for maximum optical coupling.

2. The improvement as claimed in claim 1 wherein said spacing means comprises a foil of a selected thickness interposed between said entrance end of said second fiberoptic window and the exit end of said first fiberoptic window.

3. The improvement as claimed in claim 2 wherein said two fiberoptic windows are held together by spring means to maintain said precise space for maximum optical coupling.

4. A method of making an electro-optical ion detector for a scanning mass spectrometer which includes a channel electron multiplier assembly with an image plate and a first fiberoptic window which comprises the steps of:

forming a twisted fiberoptic window comprising a plurality of optic fibers arranged in a flat ribbon-like configuration and twisted into a selected configuration, forming a spacing means on one end of said twisted fiberoptic window leaving part of said one end exposed to form an entrance to said twisted fiberoptic window.

using said spacing means to precisely space said entrance from the first fiberoptic window for the maximum efficiency optical coupling between the two fiberoptic windows.

5. The method as claimed in claim 4 including the step of cementing strips of foil to said entrance.

6. The method as claimed in claim 5 further including resiliently clamping said channel electron multiplier assembly to said entrance.

* * * * *

UNITED STATES PATENT AND TRADEMARK OFFICE

CERTIFICATE OF CORRECTION

PATENT NO. : 5,053,621

DATED : October 1, 1991

INVENTOR(S) : Bruce E. Mount

It is certified that error appears in the above-indentified patent and that said Letters Patent is hereby corrected as shown below:

Column 1, Line 64, change "section" to --sector--

Signed and Sealed this

Twelfth Day of July, 1994

Bruce Lehman

*Attest:*

BRUCE LEHMAN

*Attesting Officer*

*Commissioner of Patents and Trademarks*